United States Patent [19]

Fitch

[11] Patent Number: 4,465,146

[45] **Date of Patent: * Aug. 14, 1984**

[54] TUBULAR DRILL STRING MEMBER WITH CONTOURED CIRCUMFERENTIAL SURFACE

[75] Inventor: John L. Fitch, Dallas, Tex.

[73] Assignee: Mobil Oil Corporation, New York, N.Y.

[ * ] Notice: The portion of the term of this patent subsequent to Dec. 28, 1999 has been disclaimed.

[21] Appl. No.: 419,881

[22] Filed: Sep. 20, 1982

Related U.S. Application Data

[62] Division of Ser. No. 210,914, Nov. 28, 1980, Pat. No. 4,365,678.

[51] Int. Cl.[3] ..... E21B 7/04; E21B 17/16; E21B 17/22

[52] U.S. Cl. ..... 175/61; 175/323; 175/325

[58] Field of Search ..... 175/323, 325, 310, 394, 175/61; 166/241; 308/4 A

[56] References Cited

U.S. PATENT DOCUMENTS

| | | | |
|---|---|---|---|
| 2,869,828 | 1/1959 | McClinton | 175/394 X |
| 2,999,552 | 9/1961 | Fox | 175/323 |
| 3,085,639 | 4/1963 | Fitch | 175/323 |
| 3,194,331 | 7/1965 | Arnold | 175/323 |
| 3,360,960 | 1/1968 | Massey | 175/323 X |
| 3,372,763 | 3/1968 | Fischer | 175/323 |
| 3,762,828 | 10/1973 | Faber | 175/325 X |
| 4,036,539 | 7/1977 | Saunders et al. | 166/241 |
| 4,365,678 | 12/1982 | Fitch | 175/323 |

FOREIGN PATENT DOCUMENTS

| | | | |
|---|---|---|---|
| 571578 | 10/1977 | U.S.S.R. | 308/4 A |

*Primary Examiner*—Stephen J. Novosad
*Assistant Examiner*—Thuy M. Bui
*Attorney, Agent, or Firm*—A. J. McKillop; M. G. Gilman; J. F. Powers, Jr.

[57] ABSTRACT

A tubular member for a drill string used in the rotary drilling of deviated boreholes, which includes an outer circumferential surface which is contoured and adapted to engage the wall of the borehole so as to produce a longitudinally downward force on the drill bit upon rotation of the drill string. The tubular member may be a drill collar or section of drill pipe, wherein the contoured surface is constituted of a helical thread of a pitch which will impart a longitudinal force towards the drill bit upon rotation of the tubular member.

1 Claim, 3 Drawing Figures

TUBULAR DRILL STRING MEMBER WITH CONTOURED CIRCUMFERENTIAL SURFACE

This is a division of application Ser. No. 210,914 filed Nov. 28, 1980, U.S. Pat. No. 4,365,678, Dec. 28, 1982.

BACKGROUND OF THE INVENTION

The present invention relates to the rotary drilling of deep wellbores, particularly high-angle or "extended reach drilled" boreholes, and is particularly concerned with improved tubular drill string members, such as drill collars or drill pipe which incorporates contoured circumferential surfaces aiding in the generation of longitudinal forces towards the bottom of a deviated borehole when the drill string is rotated.

When drilling wellbores with deviated boreholes at angles which reach or exceed 60° from the vertical, the ordinary problems encountered in drilling deviated boreholes are magnified and new problems are generated. Among these new problems which arise is the obtention of an adequate weight-on-bit (WOB) at the bottom of the drill string. Essentially, weight-on-bit can be applied to the bottom of the drill string in various ways other than the utilization of the (passive) force of gravity which entails the weight of the drill string acting on the bit.

One feasible method of applying weight-on-bit consists in the use of drill collars or drill pipe which an external circumferential "spirally grooved" or "threaded" surface configuration adapted to produce a longitudinal force towards the bottom of the drill string upon rotation of the pipe during conveyance of the return flow of drilling fluid or mud over the spiral surface. Presently known drill collars which incorporate this "spiral" outer surface configuration have not been able to meet this problem in a satisfactory manner due to a surface "spiral" contour which is not suitably correlated with the required weight-on-bit conditions.

2. Discussion of the Prior Art

Described in U.S. Pat. No. 3,194,331 to E. P. Arnold is an invention relating to drill collars employed in the rotary drilling of deep wells, with the drill collars being coupled in multiple successions at the lower end of a tubular drill string for controlling weight-on-bit and for cooperation with the wellbore well in minimizing borehole deviation. A specially designed groove configuration is provided on the exterior and circumference of a drill collar. During drilling rotation of the drill string return flow of drilling fluid or mud upwardly through the annulus of the borehole about the drill string will react downwardly on the upwardly facing groove surfaces and produce an auxiliary lead acting downwardly on the bit supplemental to drill collar weighting. This will facilitate the replacement of a number of drill collars with less expensive drill pipe.

Similar structures for drill collars and drill pipes incorporating the same concept as Arnold and intended for substantially the same purpose, may be found in U.S. Pat. Nos. 2,999,552; 3,146,611; 3,360,960 and 3,554,307. All of these patents provide for spirally grooved or threaded circumferential surfaces which will assist in the weighting of the drill bit.

Although structural similarities are in evidence with respect to the tubular drill string member of the present invention and the above-mentioned prior art publications, none of the prior art patents are adapted to engage the wall of the borehole and to propagate there along due to the contoured outer surface of the tubular member so as to generate a longitudinal force towards the bottom of a deviated borehole upon rotation of the drill string.

SUMMARY OF THE INVENTION

Accordingly, it is an object of the present invention to provide a novel tubular member for a drill string used in the rotary drilling of deviated boreholes, which includes an outer circumferential surface which is contoured and adapted to engage the wall of the borehole so as to produce a longitudinally downward force on the drill bit upon rotation of the drill string.

Another object of the invention is to provide a tubular member of the type described which may be a drill collar or section of drill pipe, wherein the contoured surface is constituted of a helical thread of a pitch which will impart a longitudinal force towards the drill bit upon rotation of the tubular member.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
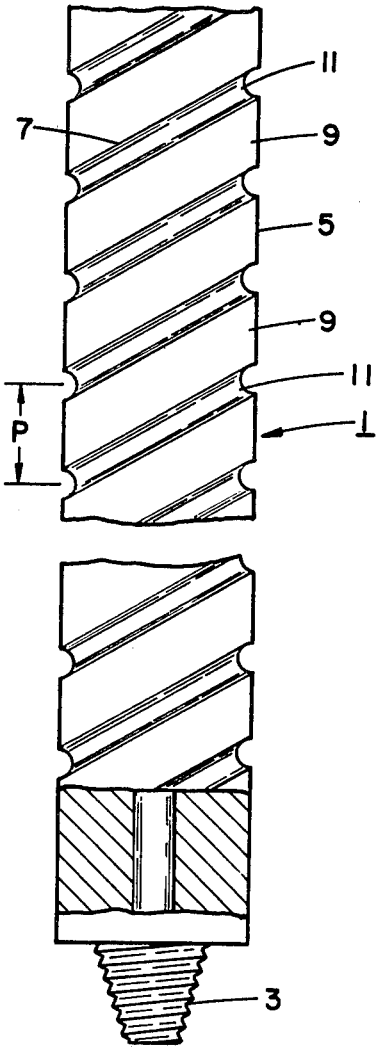
FIG. 1 illustrates a portion of a drill collar, partly in section, showing the helical threading formed on the outer circumferential surface thereof.

FIG. 1 of the drawings illustrates a tubular member 1, in this instance a drill collar, adapted to be used in a drill string for the rotary drilling of a deviated, high angle borehole. The drill collar includes, at its lower end, a male threaded portion 3 adapted to engage with the upper end of a lower pipe section or drill collar of a drill string which includes a complimentary female thread (not shown).

In accordance with the concept of the present invention, the tubular member 1 is provided along its outer circumferential surface 5 with a continouus helical thread or grooving 7 extending along the axial length of the tubular member. The thread or grooving 7 preferably is provided with hardened surface at the peaks of the recessed groove portions 11 where the grooves 7 meet the circumferential surface 5. In essence, the peaks or edges 9 where the groove portions 11 form sharp edges with the circumferential surface 5 is hardened, or alternatively, the entire circumferential surface 5 may be hardened. This surface hardening can be effected in any well known heat-treating operation for steel or metal, such as case hardening or carburizing.

In order to facilitate the smooth flow of returning drilling fluid or mud through the annulus of the borehole extending about the drill string, or in this instance, the tubular member 1, the bottom 11 of the helical thread or grooving 7 may be coated with a low-friction or "non-sticking" material, for example, polytetrafluoroethylene, sold under the registered trademark TEFLON.

Figure 3:
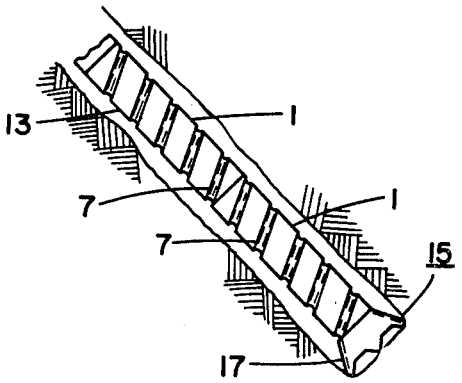
FIG. 3 schematically illustrates the lower end of a deviated borehole showing the tubular members therein as elements of a drill string.

The pitch "P" between adjacent threads or grooves 7 should be so designed that for the slow rotation of the drill string, for instance 5 r.p.m., the engagement of the continued surface 5 of the drill collar 1 with the lower wall 13 of the high angle, deviated borehole 15, as shown in FIG. 3, will cause the bit of the thread into the wall to exert a longitudinal force component downwardly in the direction of the drill bit 17. In conventional drilling the drill bit is rotated at the same rate as the drill collar. If, however, a downhole drilling motor is used to drive the bit the drill collar may be rotated at a different rate which is selected to produce a downwardly directed force of the desired magnitude.

Figure 2:
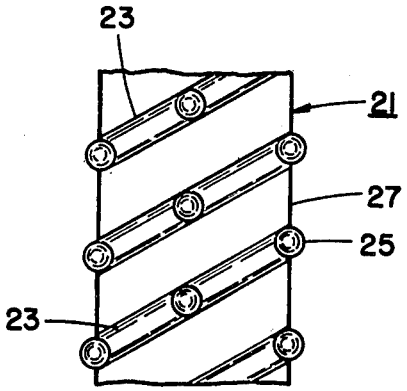
FIG. 2 illustrates a fragmentary portion of a second embodiment of the inventive tubular drill string member.

Referring to FIG. 2, there is shown a somewhat modified embodiment of a drill collar or tubular member 21 wherein the helical threads or grooving 23 may be provided with a plurality of spaced rollers or balls 25. The balls 25 project radially outwardly of the outer circumferential surface 27 of the drill collar 21 and are adapted to engage the lower wall 13 of a deviated borehole 15. In order to retain the rollers or balls 25 within the grooving 23, the peaks of the groovings adjoining the outer circumferential surface 27 may be bent or peened to encompass somewhat more than one-half the diameter of the balls 25. This will prevent the balls 25 from falling out and maintain their relative spaced positions within the grooving or helical threads. The balls 25 may be of a harder material than the drill collar 21, while the bottom of the threads 23 may be coated with a low-friction material as in the embodiment of FIG. 1.

Alternative embodiments suggest themselves in the provision of the outer circumferential surface of the drill collar with helical ribbing or flutings of the desired pitch. The present invention may have particular applicability in the drilling of boreholes in coalfields or with regard to oil shale.

Furthermore, although the invention describes the invention relative to drill collars, other drill string elements may be considered, such as sections of drill pipe or the like.

What is claimed is:

1. In a method of rotary drilling, the improvement comprising using an elongate tubular member, such as a section of drill pipe or drill collar adapted to be connected at its opposite ends in a drill string for drilling an extended reach drilled borehole, said tubular member comprising continuous contour-forming means having recessed surface portions depending below the circumferential outer surface of said tubular member being arranged in the outer circumference thereof and extending along the axis of said tubular member for producing a downwardly acting longitudinal thrust responsive to rotational movement of said tubular member along the surface of the borehole, a plurality of rollers arranged within said contour-forming means and spaced along the circumferential outer surface of said tubular member and a low-friction-surface coating material covering said recessed surface portions to facilitate the upward displacement of drilling mud or fluid through said borehole about said tubular member.

* * * * *